US005952164A

United States Patent [19]

Anderson et al.

[11] Patent Number: 5,952,164

[45] Date of Patent: Sep. 14, 1999

[54] PHOTOGRAPHIC ELEMENT CONTAINING GELATIN-MODIFIED POLYURETHANE

[75] Inventors: Charles C. Anderson, Penfield; Brian A. Schell, Honeoye Falls; Mario D. DeLaura, Hamlin, all of N.Y.

[73] Assignee: Eastman Kodak Company, Rochester, N.Y.

[21] Appl. No.: 09/090,579

[22] Filed: Jun. 4, 1998

[51] Int. Cl.[6] ..... G03C 1/93; G03C 1/835; G03C 1/89; G03C 1/047

[52] U.S. Cl. ..... 430/510; 430/215; 430/216; 430/531; 430/527; 430/533; 430/537; 430/539; 430/628; 430/642

[58] Field of Search ..... 430/527, 531, 430/533, 537, 539, 628, 642, 510, 215, 216

[56] References Cited

U.S. PATENT DOCUMENTS

| | | | |
|---|---|---|---|
| 3,240,604 | 3/1966 | Cook . | |
| 3,547,642 | 12/1970 | Nishio et al. | 430/537 |
| 4,266,015 | 5/1981 | Butler et al. | 430/527 |
| 4,855,219 | 8/1989 | Bagchi et al. | 430/537 |
| 5,066,572 | 11/1991 | O'Connor et al. | 430/537 |
| 5,173,739 | 12/1992 | Kurachi et al. | 356/124 |
| 5,248,558 | 9/1993 | Bagchi et al. | 430/537 |
| 5,330,885 | 7/1994 | Takamuki et al. | 430/537 |
| 5,804,360 | 9/1998 | Schell et al. | 430/531 |

FOREIGN PATENT DOCUMENTS

| | | |
|---|---|---|
| 476535A1 B1 | 3/1992 | European Pat. Off. . |

*Primary Examiner*—Richard L. Schilling
*Attorney, Agent, or Firm*—Carl F. Ruoff

[57] ABSTRACT

The present invention is a photographic element including a support, at least one silver halide emulsion layer superposed on said support; and at least one auxiliary layer. The auxiliary layer includes a gelatin-grafted-polyurethane which is formed by coating and subsequent drying of a coating composition comprising gelatin covalently bound to a polyurethane through a grafting agent, wherein a ratio of gelatin to polyurethane is from 1:10 to 2:1.

10 Claims, No Drawings

PHOTOGRAPHIC ELEMENT CONTAINING GELATIN-MODIFIED POLYURETHANE

CROSS REFERENCE TO RELATED APPLICATIONS

This application relates to commonly assigned copending application Ser. No. 09/090,831, filed simultaneously herewith. This application relates to commonly assigned copending application Ser. No. 09/090,576, filed simultaneously herewith. This application relates to commonly assigned copending application Ser. No. 09/090,578, filed simultaneously herewith. This application relates to commonly assigned copending application Ser. No. 09/090,827, filed simultaneously herewith.

FIELD OF THE INVENTION

The present invention relates to water-dispersible polyurethanes and to the use of such materials in imaging materials. In particular the invention relates to water-dispersible polyurethanes that have been grafted to gelatin and the use of these compositions in photographic materials.

BACKGROUND OF THE INVENTION

Hydrophilic colloids such as gelatin have many unique and desirable properties that make them especially useful in the preparation of photographic materials. For example, gelatin has high swellability in aqueous media which allows rapid diffusion of compounds in and out of a gelatin-containing photographic layer during film processing. Gelatin is also an excellent dispersing medium for light-sensitive silver halide grains and aqueous gelatin solutions exhibit excellent coating properties and quickly undergo gelation when chilled; all of these properties are critical to the manufacture of photographic films. In addition, crosslinked gelatin layers provide very good physical properties such as resistance to scratch, abrasion, ferrotyping, and blocking.

In recent years, the conditions under which photographic materials are manufactured or utilized have become more demanding. For example, applications for photographic materials have been extended to high humidity and high temperature environments. Under these conditions, conventional photographic materials may not have adequate dimensional stability or resistance to sticking, blocking, and ferrotyping. Recent patents have disclosed photographic systems (for example, Advanced Photographic Systems) where the processed film may be re-introduced into a cassette. This system allows for compact and clean storage of the processed film until such time when it may be removed for additional prints or to interface with display equipment. Storage in the cassette is preferred to facilitate location of the desired exposed frame and to minimize contact with the negative during subsequent usage. U.S. Pat. No. 5,173,739 discloses a cassette to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which may result in ferrotyping, especially at high temperature and high humidity storage conditions. In order to maximize productivity and reduce cost, photographic materials must be manufactured and processed at very high speeds, thus they may be more easily scratched and abraded. These scratches or abrasion marks are visible during printing or projection of the photographic material.

Various methods have been described to improve the physical properties of hydrophilic colloid-containing layers used in imaging. For example, U.S. Pat. No. 3,240,604 describes a gelatin layer containing discrete poly (tetrafluoroethylene) granules present in a concentration range of 0.05 to 10 parts of poly(tetrafluoroethylene) per part gelatin. U.S. Pat. No. 4,266,015 describes a light sensitive material which includes an outermost layer comprising a fluorine-containing homopolymer or copolymer. Due to their very hydrophobic nature, these fluoropolymers are not very compatible with coating solutions containing a hydrophilic colloid such as gelatin. In addition, these polymer particles can fall-off in processing solutions due to their weak interaction with the hydrophilic colloid binder.

The addition of latex polymers prepared from ethylenically unsaturated monomers to hydrophilic colloid-containing layers to achieve improved properties such as, increased dimensional stability, reduced curl, decreased pressure sensitivity, improved dryability, and improved scratch resistance, is described, for example, in Research Disclosure No. 38957, September 1996, page 601. However, when a large amount of the latex is added to the gelatin, the latex may flocculate. In addition, when a large amount of the latex is added to the hydrophilic colloid-containing outermost protective layer, the latex, especially if it is a low Tg latex, may cause sticking and blocking of the photographic material when it is stored at high temperature.

Methods have been described that reportedly improve the compatibility between the latex polymer and the hydrophilic colloid in order to prevent flocculation of the latex and to improve the adhesion between the latex polymer and the hydrophilic colloid. For example, in U.S. Pat. Nos. 4,855,219, 5,066,572, 5,248,558, 5,330,885, and others, gelatin-coated latex polymers and gelatin-grafted latex polymers and their use in photographic elements are described. Typically, these latex polymers are either soft or hard (meth)acrylate copolymer latexes that provide good, but, not outstanding resistance to scratch, abrasion, and ferrotyping. Therefore, there continues to be a need to further improve the physical performance of photographic materials without sacrificing coating solution stability, surface tackiness, etc. It is toward such an objective that the present invention is directed.

SUMMARY OF THE INVENTION

The present invention is a photographic element including a support, at least one silver halide emulsion layer superposed on said support; and at least one auxiliary layer. The auxiliary layer includes a gelatin-grafted-polyurethane which is formed by coating and subsequent drying of a coating composition comprising gelatin covalently bound to a polyurethane through a grafting agent, wherein a ratio of gelatin to polyurethane is from 1:10 to 2:1.

DETAILED DESCRIPTION OF THE INVENTION

In accordance with the present invention, a photographic element comprises a support having thereon at least one layer coated from an aqueous coating solution having therein a polyurethane which is gelatin-grafted. Dried layers containing the gelatin-grafted polyurethanes of the invention are useful for a wide range of layers commonly used on photographic materials. The gelatin-grafted polyurethanes are prepared by taking a dispersion of a polyurethane containing carboxylic acid or carboxylic acid salt groups in water and incorporating a gelatin grafting agent into said polyurethane dispersion and adding gelatin solution to said polyurethane dispersion to form a gelatin-grafted polyurethane dispersion.

The gelatin-grafted polyurethane compositions of the invention are useful for a wide variety of applications in photographic elements. For example, they may be added to one or more hydrophilic colloid-containing layers such as light-sensitive silver halide emulsion layers, curl control layers, antihalation layers, surface protective overcoats, and the like. They may also be used in subbing layers, backing layers, antistatic layers, and the like. Compared with the gelatin-grafted latex polymers described in the prior art, gelatin-grafted polyurethanes provide improved physical properties due to the superior combination of strength, modulus, and toughness typical of polyurethanes compared with conventional (meth)acrylic latex polymers.

The polyurethanes useful in the present invention are water dispersible polyurethanes containing carboxylate groups, such as carboxylic acid or carboxylic acid salt groups, that are covalently bonded to gelatin with the aid of a grafting agent. Water dispersible polyurethanes are well known and are prepared by chain extending a prepolymer containing terminal isocyanate groups with an active hydrogen compound, usually a diamine or diol. The prepolymer is formed by reacting a diol or polyol having terminal hydroxyl groups with excess diisocyanate or polyisocyanate. To permit dispersion in water, the prepolymer is functionalized with hydrophilic groups. Anionic, cationic, or nonionically stabilized prepolymers can be prepared.

Anionic dispersions contain usually either carboxylate or sulphonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized prepolymers can be prepared by the use of diol or diisocyanate co-monomers bearing pendant polyethylene oxide chains. These result in polyurethanes with stability over a wide range of pH. Nonionic and anionic groups may be combined synergistically to yield "universal" urethane dispersions. For the purpose of the present invention, the polyurethane dispersion contains anionic groups that are carboxylic acid salt groups. The polyurethane dispersion may also contain nonionic groups in combination with the carboxylic acid salt anionic groups. In order to provide sufficient carboxylate groups for grafting it is necessary that the polyurethane has an acid number of at least 5. Acid number is defined as the milligrams of KOH required to neutralize one gram of polymer.

One of several different techniques may be used to prepare polyurethane dispersions. For example, the prepolymer may be formed, neutralized or alkylated if appropriate, then chain extended in an excess of organic solvent such as acetone or tetrahydrofuran. The prepolymer solution is then diluted with water and the solvent removed by distillation. This is known as the "acetone" process. Alternatively, a low molecular weight prepolymer can be prepared, usually in the presence of a small amount of solvent to reduce viscosity, and chain extended with diamine just after the prepolymer is dispersed into water. The latter is termed the "prepolymer mixing" process and for economic reasons is much preferred over the former.

Polyols useful for the preparation of polyurethane dispersions include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanates that can be used are as follows: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines which are used to neutralize the acid and form an anionic group for water dispersibility are trimethylamine, triethylamine, dimethylaniline, diethylaniline, triphenylamine and the like.

Diamines suitable for chain extension of the polyurethane include ethylenediamine, diaminopropane, hexamethylene diamine, hydrazine, aminoethylethanolamine and the like.

Solvents which may be employed to aid in formation of the prepolymer and to lower its viscosity and enhance water dispersibility include methylethylketone, toluene, tetrahydrofuran, acetone, dimethylformamide, N-methylpyrrolidone, and the like. Water-miscible solvents like N-methylpyrrolidone are much preferred.

The polyurethanes useful in the practice of the present invention may be either glassy polyurethanes (i.e., $T_g$ greater than about 25° C.) or they may be rubber polyurethanes (i.e., $T_g$ less than about 25° C.) depending on the use for which they are intended. For example, when the gelatin-grafted polyurethanes of the invention are to be used in subbing layers or cushioning layers it may be desirable to use a rubber polyurethane. However, when the gelatin-grafted polyurethane is to be used in an outermost layer such as a protective overcoat layer it may be desirable to use a glassy polyurethane in order to provide the best resistance to scratch and sticking.

The gelatin to be covalently bound to the polyurethane can be any of the known types of gelatin. These include, for example, alkali-treated gelatin (cattle bone or hide gelatin), acid-treated gelatin (pigskin or bone gelatin), and gelatin derivatives such as partially phthalated gelatin, acetylated gelatin, and the like, preferably the deionized gelatins. The gelatin covalently bound to the polyurethane may be crosslinked through the use of a coventional crosslinking agent. The ratio of gelatin to polyurethane is between 1 to 10 and 2 to 1, preferably between 1 to 4 and 2 to 1.

Suitable grafting agents that can be utilized for the attachment of gelatin to the polyurethane are the carbamoylonium salts, dication ethers, and carbodiimides described in U.S. Pat. No. 5,248,558, incorporated herein by reference. The carbamoylonium compounds useful in the practice of the present invention can be obtained commercially, or prepared using known procedures and starting materials, such as described in U.S. Pat. No. 4,421,847 and references noted therein, incorporated herein by reference. Representative preferred carbamoylonium compounds include 1-(4-morpholinocarbonyl)-4-(2-sulfoethyl)pyridinium hydroxide, inner salt, and 1-(4-morpholinocarbonyl) pyridinium chloride.

Dication ethers are also useful as grafting agents for bonding gelatin to a polyurethane containing carboxylate groups. Useful dication ethers have the formula:

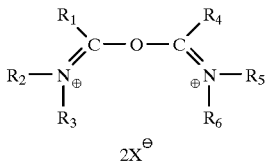

In this formula, $R_1$ represents hydrogen, alkyl, aralkyl, aryl, alkenyl, —$YR_7$, the group

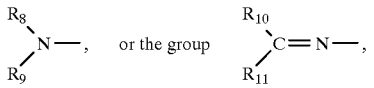

with Y representing sulfur or oxygen, and $R_7$, $R_8$, $R_9$, $R_{10}$, and $R_{11}$ each independently representing alkyl, alkyl, aralkyl, aryl, or alkenyl. Alternatively, $R_8$ and $R_9$, or $R_{10}$ and $R_{11}$ may together form a ring structure. $R_{10}$ and $R_{11}$ may each also represent hydrogen. Also, $R_1$ together with $R_2$ may form a heterocyclic ring.

$R_2$ and $R_3$ each independently represents alkyl, aralkyl, aryl, or alkenyl, or, combined with $R_1$ or each other, forms a heterocyclic ring. $R_4$, $R_5$, and $R_6$ are independently defined as are $R_1$, $R_2$, and $R_3$, respectively, and can be the same as or different from $R_1$, $R_2$, and $R_3$.

$X^-$ represents an anion or an anionic portion of the compound to form an intramolecular (inner) salt. The ethers above can be made by techniques known to those skilled in the chemical synthesis art. Useful synthesis techniques include thos described in *Journal Of American Chemical Society,* 103, 4839 (1981).

Carbodiimides can also be used to attach gelatin to carboxylated polyurethanes. Particularly preferred carbodiimide grafting agents are water-soluble carbodiimides of the formula:

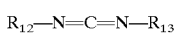

wherein each of $R_{12}$ or $R_{13}$ is selected from: cycloalkyl having from 5 to 6 carbon atoms in the ring: alkyl of from 1 to 12 carbon atoms; monoarylsubstituted lower alkyl radicals, e.g., benzyl-α- and β-phenylethyl; monoaryl radicals, e.g., phenyl; morpholino; piperidyl; morpholinyl substituted with lower alkyl radicals, e.g., ethylmorpholinyl; piperidyl substituted with lower alkyl radicals, e.g., ethylpiperidyl; di-lower alkylamino; pyridyl substituted with lower alkyl radicals, e.g., α, β, γ-methyl-or ethyl-pyridyl; acid addition salts; and quaternary amines thereof.

For the grafting of gelatin to the polyurethane dispersion, the polyurethane dispersion is preferably first contacted with the grafting agent and then with gelatin, so that the gelatin preferentially reacts with the polyurethane, instead of gelatin-gelatin cross-linking. Carbamoylpyridinium and dication ether grafting agents are advantageously utilized in the practice of this invention as these may be employed to selectively bond to a carboxyl group on a polymer particle and then with an amino group on the gelatin molecule. Carbamoylpyridinium compounds are particularly preferred.

The contacting of the polyurethane and gelatin is preferably performed in an aqueous medium. The concentration of polyurethane in the aqueous dispersion is preferably less than about 25% and more preferably less than about 15% by weight. The concentration of gelatin in the aqueous dispersion is preferably less than about 25% and more preferably less than about 15% by weight.

The pH of the aqueous dispersion and the concentration of the polyurethane and gelatin should be adjusted to prevent bridging of gelatin molecules between the polyurethane dispersion, or coagulation. The pH of the gelatin is preferably maintained above the isoelectric pH of the gelatin (e.g., above 4.8 and preferably between 8 and 10 for lime-processed bone gelatin). Under such conditions, both the polyurethane dispersion and the gelatin should have the same charge, preferably negative, in order to minimize coagulation.

It is preferred for this invention that the gelatin-grafted polyurethane dispersion be washed extensively either by dialysis or diafiltration to remove traces of reaction byproducts and low molecular weight species.

The gelatin-grafted polyurethane dispersions of the invention can be used in coating compositions alone or in combination with other water-dispersible or water soluble polymers, including; latex polymers prepared from ethylenically unsaturated monomers such as (meth)acrylic acid, (meth)acrylic acid esters, styrene and its derivatives, vinyl halides, itaconic acid and its mono- and di-esters, maleic acid and its mono- and di-esters, (meth)acrylonitrile, (meth) acrylamides, olefins, and others; water dispersible polyurethanes and polyesters; hydrophilic colloids such as gelatin, dextran, gum arabic, zein, cassein, pectin, agar-agar, polyvinyl alcohol, poly(vinyl pyrrolidone), and the like. Preferably, the gelatin-grafted polyurethane dispersions of the invention comprise from about 5 to 100 weight % of the dried layer.

Coatings containing the gelatin-grafted polyurethane dispersions may additionally include; crosslinking agents such as aziridines, carbodiimides, epoxides, triazines, polyisocyanates, and methoxyalkyl melamines; gelatin hardeners such as those described, for example, in Research Disclosure No. 38957, September 1996, pages 599 to 600; conductive agents such as electrically-conductive water-soluble or water-dispersible polymers or electrically-conductive metal oxide particles, fibers, or whiskers; inorganic fillers such as clays, silica, mica, $TiO_2$ particles, etc.; magnetic recording particles; lubricants; dyes and pigments; surfactants and coating aids; rheology modifiers; and inorganic or polymeric matting agents.

Coatings containing the gelatin-grafted polyurethane dispersions of the invention may be applied onto various substrates including; plastics, metal, paper, resin-coated paper, glass, and the like, using well-known coating techniques such as hopper coating, air-knife coating, gravure coating, roller coating, dip coating, spray coating, wire rod coating, and curtain coating.

The gelatin-grafted polyurethane dispersions of the invention are particularly useful when employed in one or more layers on a photographic element. Details with respect to the composition and function of a wide variety of different photographic elements are provided in U.S. Pat. No. 5,300,676 and references described therein. The gelatin-grafted polyurethanes of the present invention can be effectively employed in conjunction with any of the photographic elements described in the '676 patent. The gelatin-grafted polyurethanes may be used in an image forming layer or auxiliary layer of the photographic element. Typical auxiliary layers on imaging elements include, overcoat layers, spacer layers, curl control layers, filter layers, interlayers, antihalation layers, pH lowering layers, timing layers, opaque reflecting layers, opaque light-absorbing layers, subbing layers, antistatic layers, backing layers, magnetic recording layers, undercoat or primer layers, and the like.

The radiation sensitive silver halide grains present in the emulsions using the gelatin-grafted polyurethane of the present invention can be comprised of silver chloride, silver bromide or mixtures thereof and can optionally include iodide within their crystal lattice structure. Useful emulsions can be chosen from among those disclosed in Research Disclosure, Vol. 389, September 1996, Item 38957, I. Emulsion grains and their preparation. Research Disclosure is published by Kenneth Mason Publications, Ltd., Dudley House, 12 North St., Emsworth, Hampshire P010 7DQ, England. In a preferred form of the invention the radiation sensitive grains form surface latent images on imagewise exposure. The grains that have been exposed are those that are developed. In other words, the emulsions are negative working.

The present invention is also directed to a single-use camera having incorporated therein a photographic material as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the single-use camera to the consumer does not normally occur, however, the photographic material will be returned.

The photographic processing steps to which the raw film may be subject may include, but are not limited to the following:

(1) color developing→bleach-fixing→washing/stabilizing;

(2) color developing→bleaching→fixing→washing/stabilizing;

(3) color developing bleaching→bleach-fixing→washing/stabilizing;

(4) color developing→stopping→washing→bleaching→washing →fixing→washing/stabilizing;

(5) color developing→bleach-fixing→fixing→washing/stabilizing;

(6) color developing→bleaching→bleach-fixing→fixing→washing/stabilizing;

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The present invention will now be described in detail with reference to examples; however, the invention should not be limited to these examples.

EXAMPLES

Preparation of Gelatin-grafted Polyurethane Dispersions

Gelatin-grafted polyurethane P-1: A commercially available, water-dispersible glassy polyurethane (Sancure 898, a product of BF Goodrich) was grafted to gelatin at a weight ratio of 60 parts polyurethane to 40 parts gelatin by the following procedure: 80 g of polyurethane dispersion (32% solids) and 145 g distilled water were introduced to a 1 liter roundbottom 3-necked flask equipped with a condenser and overhead stirrer. The flask was immersed in a constant temperature bath at 60° C. 0.68 g of 1-(4-morpholinocarbonyl)-4-(2-sulfoethyl)pyridinium hydroxide, inner salt was dissolved in 75 g of water and added to the diluted polyurethane dispersion, an amount of grafting reagent equivalent to 20% of the polyurethane acid groups. Reaction was continued for 40 minutes, during which time 17.0 g of gelatin was dissolved in 153 g of water with heating at 60° C. and neutralized to pH 9 with triethylamine. The gelatin solution was then added via dropping funnel and the grafting reaction allowed to proceed for another 30 minutes. After cooling to 40° C. the product was filtered, with very little insoluble matter observed, then refrigerated. The gelatin-grafted polyurethane dispersion so obtained was stable to storage for months.

Gelatin-grafted polyurethane P-2: A water-dispersible rubbery polyurethane (Witcobond 236, a product of Witco Corp.) was grafted to gelatin by the same process employed in Example 1. 213 g of polyurethane dispersion at 20% solids was further diluted with 200 g water and allowed to react with 1.1 g of 1-(4-morpholinocarbonyl)-4-(2-sulfoethyl)pyridinium hydroxide, inner salt for 45 minutes at 60° C. 278 g of a 10% solids pH 9 gelatin solution was then added and reaction continued for 40 minutes. This product was refrigerated without filtration and was observed to contain no insolubles when re-melted 2 months after preparation.

The above gelatin-grafted polyurethane dispersions were used in the following example coating compositions.

Testing:

Wet adhesion for the coatings was tested by placing the samples in film developer at 35° C. for 1 minute. While still wet, a one millimeter wide line was scribed in the coating and a hard rubber pad was rubbed across the scribe line. The change in the width of the scribe line was used as a measure of the wet adhesion (i.e., excellent adhesion in this test means no observable change in the width of the scribe line). Dry adhesion for the coatings was determined by scribing small hatch marks in the coating with a razor blade, placing a piece of high tack tape over the scribed area and then quickly pulling the tape from the surface. The amount of the scribed area removed was used as a measure of the dry adhesion( i.e., excellent adhesion in this test means no coating removal observed). The surface electrical resistivity for an antistatic coating was measured using a two-point probe. The internal electrical resistivity for a buried antistatic layer was measured by the procedure described in R. A. Elder, "Resistivity Measurements on Buried Conductive Layers" EOS/ESD Symposium Proceedings, September 1990, pages 251–254.

During routine film development, by-products of oxidized color developer will form brown, oily residue (i.e., "tar") in the film processor tanks that may be adsorbed by the film surface and may create permanent, brown stained spots. These tar stains may occur on hydrophobic surfaces such as, for example, a polyurethane backing layer.

A simulated developer tar test was performed on some samples to determine their propensity for tar/stain build-up. The test was done at 42° C. and involved smearing tar harvested from a developer tank onto the coating immersed in a developer bath followed by removal of the tar using dilute sulfuric acid. The resultant stain or tar is indicative of the propensity of the coating for tar adsorption. The resistance to tar stain was visually rated on a scale of 1 to 5, with 1 being the best performance, (i.e., no tar stain) and 5 being the worst performance (i.e., severe tar stain).

Example 1 and 2

These examples demonstrate that the gelatin-grafted polyurethanes of the invention form highly transparent, adherent films when applied to a polyester film support that is commonly used for photographic elements. A polyethylene terephthalate film support that had been previously coated with a priming layer comprising a vinylidene chloride-containing interpolymer that is well known in the art was coated with the following compositions:

Example 1:

Polymer P-1 7 wt %

Triton X-100 Surfactant (Rohm & Haas) 0.06 wt %

CX100 polyfunctional aziridine (Zeneca Resins) 0.35 wt % water balance

Example 2:

Polymer P-2 7 wt %

Triton X-100 Surfactant (Rohm & Haas) 0.06 wt %

CX100 polyfunctional aziridine (Zeneca Resins) 0.35 wt % water balance

The coatings were dried at 100° C. for 3 minutes to give layers with a dried coating weight of 1000 mg/m$^2$. Both coatings were transparent and gave excellent wet and dry adhesion to the film support.

Example 3

The following example demonstrates the utility of the gelatin-grafted polyurethanes of the invention as a priming/subbing layer. The following composition was applied onto a corona discharge treated, biaxially oriented polyethylene terephthalate film support (this support did not contain the vinylidene chloride-containing interpolymer priming layer used in the previous examples) and dried at 130° C. for 2 minutes to give a layer with a dried coating weight of 100 mg/m$^2$.

Polymer P-2 0.7 wt %

Triton X-100 Surfactant (Rohm & Haas) 0.06 wt %

CX100 polyfunctional aziridine (Zeneca Resins) 0.035 wt % water balance

This coating gave excellent wet and dry adhesion to the energy-treated film support. This layer was also overcoated with a 5000 mg/m$^2$ gelatin layer to simulate overcoating the priming layer with a hydrophilic silver halide emulsion layer or curl control layer. After coating, the thick gelatin layer was chill-set at 5° C. and first dried at 21° C. and then at 38° C. This gelatin overcoat layer also contained about 1 wt % of a bis(vinylsulfonylmethyl)ether gelatin-hardening agent. This example gave excellent wet and dry adhesion of the gelatin overcoat to the gelatin-grafted polyurethane priming layer.

Example 4

The following example demonstrates the utility of the gelatin-grafted polyurethanes of the invention in an antistatic layer containing a conductive metal oxide (antimony-doped tin oxide). The following composition was applied onto the primed polyethylene terephthalate film support used in examples 1 and 2, and then dried at 100° C. for 2 minutes to give a layer with a dried coating weight of 35 mg/m$^2$.

Polymer P-2 0.75 wt %

CPM375 antimony-doped tin oxide (Keeling and Walker) 2.25 wt %

Triton X-100 surfactant (Rohm & Haas) 0.06 wt %

CX100 polyfunctional aziridine (Zeneca Resins) 0.04 wt % water balance

This coating gave excellent wet and dry adhesion to the film support and had a surface electrical resistivity of 9.3 log Ω/□. This layer was also overcoated with the thick gelatin layer described in example 3. This sample gave excellent wet and dry adhesion of the gelatin overcoat to the antistatic layer and had an internal electrical resistivity of 9.8 log Ω/□.

Example 5

The following example demonstrates the utility of the gelatin-grafted polyurethanes of the invention in a topcoat layer, and particularly in a topcoat layer that resists processor tar stains. The gelatin-grafted polyurethanes were employed in a topcoat layer for a protective overcoat comprising a conventional water-dispersible polyurethane. The polyurethane protective overcoat was applied over an antistatic formulation.

Preparation of support containing an antistatic layer:

The primed polyethylene terephthalate support described in examples 1 and 2 was coated with an antistatic formulation consisting of the following components:

Terpolymer of acrylonitrile, vinylidene chloride and acrylic acid, 30 wt % solids 0.094 wt %

Vanadium pentoxide colloidal dispersion, 0.57 wt % solids 4.97 wt %

Triton X-100 surfactant (Rohm & Haas) 0.03 wt %

Demineralized water balance

Comparative Sample A comprised a polyurethane overcoat formulation applied over the antistatic layer. The overcoat layer consisted of the following components:

| | Dry Coverage, mg/m$^2$ |
|---|---|
| Sancure 898 polyurethane dispersion, (B. F. Goodrich Corp.) | 972 |
| Camauba wax dispersion, Michemlube 160 (Michelman Inc.) | 0.65 |
| Matte, polymethyl methacrylate beads, 1.47 μm | 26.9 |

-continued

| | Dry Coverage, $mg/m^2$ |
|---|---|
| CX100 polyfunctional aziridine (Zeneca Resins) | 60.8 |
| Triton X-100 | 10.8 |

A polyurethane overcoat identical to Comparative Sample A—excepting the carnauba wax was omitted—was prepared and a gelatin-grafted polyurethane topcoat comprising the following ingredients was applied over the polyurethane overcoat to produce Example 5. The dried coating weight for the gelatin-grafted polyurethane topcoat layer was 100 $mg/m^2$.

Polymer P-1 7 wt %
Triton X-100 Surfactant (Rohm & Haas) 0.06 wt %
CX100 polyfunctional aziridine (Zeneca Resins) 0.35 wt %
water balance When tested for resistance to tar stain, Example 5 gave a tar stain rating of 1, which is excellent performance in this test. By comparison, Comparative Sample A, which did not contain a gelatin-grafted topcoat, gave a tar stain rating of 5 (i.e., severe tar stain).

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide emulsion layer superposed on said support; and at least one auxiliary layer formed by coating and subsequent drying of a coating composition comprising gelatin-grafted polyurethane comprising gelatin covalently bound to a polyurethane through a grafting agent, wherein a ratio of gelatin to polyurethane is from 1:10 to 2:1.

2. The photographic element of claim 1, wherein said gelatin-grafted polyurethane is formed by providing a polyurethane dispersion containing carboxylate groups wherein the polyurethane dispersion has an acid number of at least 5;

contacting the polyurethane dispersion with a grafting agent;

contacting the polyurethane dispersion with gelatin to form a polyurethane covalently bonded to wherein a ratio of gelatin to polyurethane is from 1:10 to 2:1.

3. The photographic element of claim 1, wherein said grafting agent is selected from the group consisting of carbamoylonium salts, dication ethers, and carbodiimides.

4. The photographic element of claim 1, wherein the auxiliary layer further comprises another polymer selected from the group consisting of water soluble polymers or water dispersible polymers.

5. The photographic element of claim 1, wherein the auxiliary layer further comprises crosslinking agents, conductive agents, fillers, magnetic recording particles, dyes, pigments, coating aids, surfactants, rheology modifiers, lubricating agents or matting agents.

6. The photographic element of claim 1, wherein the auxiliary layer comprises overcoat layers, spacer layers, curl control layers, filter layers, interlayers, antihalation layers, pH lowering layers, timing layers, opaque reflecting layers, opaque light-absorbing layers, subbing layers, antistatic layers, backing layers, magnetic recording layers, undercoat layers or primer layers.

7. A photographic element comprising:

a support;

at least one silver halide emulsion layer superposed on said support comprising gelatin-grafted polyurethane and silver halide grains, wherein the at least one silver halide emulsion layer is formed by coating and subsequent drying of a coating composition comprising gelatin covalently bound to a polyurethane through a grafting agent, wherein a ratio of gelatin to polyurethane is from 1:10 to 2:1.

8. The photographic element of claim 7 wherein the gelatin-grafted polyurethane is formed by:

providing a polyurethane dispersion containing carboxylate groups wherein the polyurethane dispersion has an acid number of at least 5;

contacting the polyurethane dispersion with a grafting agent;

contacting the polyurethane dispersion with gelatin to form a polyurethane covalently bonded to wherein a ratio of gelatin to polyurethane is from 1:10 to 2:1.

9. The photographic element of claim 7, wherein said grafting agent selected from the group consisting of carbamoylonium salts, dication ethers, and carbodiimides.

10. The photographic element of claim 7, wherein said silver halide emulsion layer further comprises another polymer selected from the group consisting of water soluble polymers or water dispersible polymers.

* * * * *